US005441187A

United States Patent [19]

Mixson

[11] Patent Number: 5,441,187

[45] Date of Patent: Aug. 15, 1995

[54] HOLSTER SAFETY SNAP ASSEMBLY

[75] Inventor: Robert Mixson, Hialeah, Fla.

[73] Assignee: Mixson Leathercraft, Hialeah, Fla.

[21] Appl. No.: 196,708

[22] Filed: Feb. 15, 1994

[51] Int. Cl.[6] ..... F41C 33/02; A44B 17/00

[52] U.S. Cl. ..... 224/243; 224/192; 224/235; 224/238; 224/240; 224/911; 24/578

[58] Field of Search ..... 224/191, 192, 193, 198, 224/232, 234, 235, 236, 237, 238, 240, 241, 242, 243, 246, 911, 914; 24/578

[56] References Cited

U.S. PATENT DOCUMENTS

| | | | |
|---|---|---|---|
| 3,531,031 | 9/1970 | Angell | 224/238 |
| 4,270,680 | 6/1981 | Bianchi | 224/193 |
| 4,286,741 | 9/1981 | Rogers | 224/238 |
| 4,694,980 | 9/1987 | Rogers | 224/243 |
| 5,217,151 | 6/1993 | Parsons | 224/236 |

*Primary Examiner*—J. Casimer Jacyna
*Assistant Examiner*—Charles R. Eloshway
*Attorney, Agent, or Firm*—Malloy & Malloy

[57] ABSTRACT

To be used preferably in combination with a weapon holster, a safety snap assembly including a first snap member disposed on a first segment of the holster, a second snap member disposed on a second, strap segment of the holster such that the first and second snap members will be matingly and releasably engaged with one another, disengagement being achieved by pushing an exposed actuator end extending from an exterior of a free distal end of the second segment towards the first and second segments. Further, the assembly includes a third snap member disposed on an exterior of the free distal end of the second segment, opposite the second snap member, and a fourth snap member disposed on a distal end of a third segment which is secured to the first segment, the third and fourth snap members being structured and disposed to be matingly and releasably engaged with one another, disengagement of the third and fourth snap members being achieved by pushing a concealed actuator end extending from a distal end of the third segment away from the second and third segments, disengagement of the third and fourth snap members being required prior to disengagement of the first and second snap members being achieved, the actuator end which disengages the third and fourth snap members being concealed behind the actuator end which disengages the first and second snap members.

10 Claims, 1 Drawing Sheet

HOLSTER SAFETY SNAP ASSEMBLY

BACKGROUND OF THE INVENTION

1. Field of the Invention

The present invention relates to a holster safety snap assembly utilized to retain a weapon within a holster and be substantially quick and easy to release for the weapon user, but substantially difficult to release by unwanted users attempting to steal or otherwise unnoticeably remove the weapon from the holster.

2. Description of the Related Art

Gun holsters, particularly those used by police officers, are generally adapted with a strap assembly which retains the weapon within the holster until released by the police officer. The strap of the holster can be held in place over the weapon in many ways, but often, a snap assembly using matingly disposed male and female snap members is utilized. For example, a common type of snap assembly utilizes uni-directional snaps between the holster and the strap, wherein a "thumb break" protruding from the strap is used to disengage the snaps when it is pushed towards the body of the person wearing the holster on a gun belt. More particularly, the strap in such devices will normally be snapped to an interior side of the holster, with the "thumb break" protruding upwardly for easy access such that the police officer or other person wearing the holster can quickly push the "thumb break" towards the body, thereby releasing the snap, to remove the weapon. With this type of device, an individual attempting to remove the weapon from the holster will need to push the "thumb break" towards the body of the police officer, which will be noticeable to the officer. Unfortunately, this assembly is not always effective for providing maximum safety, especially in physical situations or crowded areas. The quick, obvious steps which must be performed by an unwanted user to release the snap and remove the gun often may not give a police officer sufficient time to react. Further, because the "thumb break" is readily visible and accessible, unwanted users know the precise location on the officer's holster that they need to reach for when attempting to maneuver quickly and remove the weapon from the holster.

For this reason, numerous attempts have been made in the past to provide holsters for guns which offer increased safety in terms of a) keeping the weapon within the holster, b) making it difficult for an unwanted person to remove the weapon, while at the same time, c) allowing the wearer to quickly remove the weapon from the holster in case of an emergency. One attempt at such a device includes utilizing snaps on the holster which must be particularly aligned if they are to open. Unfortunately, while being effective to slow down a thief, such a device will also unnecessarily slow down a police officer who must focus his attention on the holster, wasting precious time to precisely align the "thumb break" such that the snaps will be properly oriented and releasable. Still other devices have attempted to conceal the "thumb break" by making it smaller so as to conceal it behind the holster while simultaneously positioning a fake "thumb break" which is really riveted to an exterior of the holster instead of snapped thereto. Unfortunately, while these designs conceal the true "thumb break" from a thief, they also are difficult to access by the person wearing the holster. A problem exists with all of these systems in that they employ a single "thumb break" and if a thief or other individual succeeds in accessing the "thumb break" he may easily remove the weapon Still other holster designs utilize more than one strap over the weapon. For example, in one such design, the primary strap is released utilizing the "thumb break" and then, a second strap must be disengaged by a forward, rolling movement of the weapon which requires that the barrel of the weapon be pointed rearwardly. This technique, however, is dangerous and ineffective as it requires an officer to point his gun barrel backwards rather than forwards and in a protective way upon removal of the weapon from the holster.

Accordingly, it would be highly beneficial to provide an assembly which will substantially increase the safety of maintaining a weapon within a holster such that it will be difficult for an unwanted user to remove the weapon quickly, yet which is quickly and easily accessible to a police officer or other person wearing a holster who must remove the weapon quickly in an emergency situation.

The safety snap assembly is designed precisely to provide such an accessible and easy opening snap assembly which nonetheless provides substantially increased security and safety by making it difficult for an unwanted user to release the snaps quickly and unnoticeably. Further, it would be highly beneficial to provide a security snap assembly which could be adapted for effective use on a variety of other containers such as a purse, briefcase, or knife sheath.

SUMMARY OF THE INVENTION

A safety snap assembly to be used primarily in combination with a weapon holster. The weapon holster is preferably of the type including a primary holding housing with a first protruding containment segment extending upwardly from an inner side thereof and a second strap segment extending from an outer side thereof. The second strap segment is positioned such that it can be disposed about a rear of the weapon contained within the weapon holding housing and secured at the first protruding containment segment, thereby containing the weapon within the housing. Specifically, the safety snap assembly includes a first snap member disposed on the first segment. Further, a second snap member which is structured and disposed to be matingly engaged with the first snap member is included. This second snap member is positioned on an interior surface of a free distal end of the second segment such that a free distal end of the second segment is removably securable to the first segment upon snapped engagement of the first snap member with the second snap member. Secured to an exterior of the free distal end of the second segment are a first release means. These first release means are adapted to facilitate disengagement of the second snap member from the first snap member and include a protruding exposed actuator end. The actuator end is adapted to be pushed towards the first and second segments so as to disengage the second snap member from the first snap member. Also positioned on the exterior of the free distal end of the second segment is a third snap member. This third snap member is preferably positioned opposite the second snap member on the second segment. Additionally, a third segment, having a proximal end and a distal end, is fixedly secured, at its proximal end, to the first segment. Positioned on an interior of the distal end of the third segment is a fourth snap member. This fourth snap member is adapted to be matingly and releasably engaged with the third snap member on the exterior of the free distal end of the second segment. In order to facilitate disengagement of the fourth snap member from the third snap member, a second release means are included. These second release means are secured to an exterior of the distal end of the third segment and include a concealed actuator end. The concealed actuator end is adapted to be pushed away from the second and third segment so as to disengage the fourth snap member from the third snap member. When in position, the actuator end on the first release means is sized to conceal the actuator end on the second release means there behind, the snap members being positioned relative to one another such that disengagement of the fourth snap member from the third snap member is required before disengagement of the second snap member from the first snap member can be achieved utilizing the first release means.

It is an object of the present invention to provide a safety snap assembly which while being quick and easy to open by a user who is familiar with the operation of the snap assembly, will be difficult to unfasten, and highly noticeable if attempted, by an unwanted, unfamiliar individual.

Still another object of the present invention is to provide a security snap assembly which is used on a weapon holster, such as a police firearm holder, and which will be quick and easy to unfasten by the officer in order to quickly remove their weapon from the holster.

A further object of the present invention is to provide a safety snap assembly for use on a weapon holster which provides the illusion of easy to open, single step releasing while in fact requiring specific maneuvers in order to release the assembly.

Still another object of the present invention is to provide a safety snap assembly to be used on a weapon holster which makes an attempted removal of the weapon within the holster substantially noticeable to a wearer of the holster due to the steps required to release the weapon from the holster.

Yet another object of the present invention is to provide a safety snap assembly for use with a weapon holster which can be easily implemented on existing holsters and which will be substantially easy for the holster user to implement and adapt to during use.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
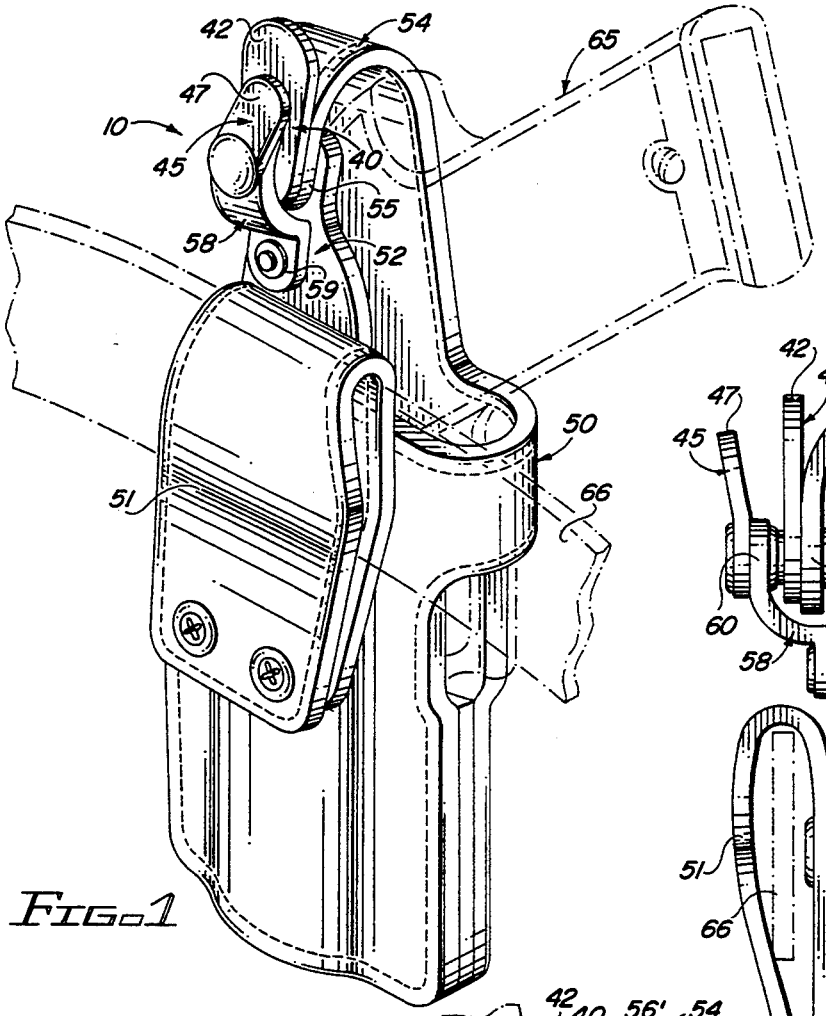
FIG. 1 is a perspective view of the safety snap assembly in use on a weapon holster.
Figure 2:
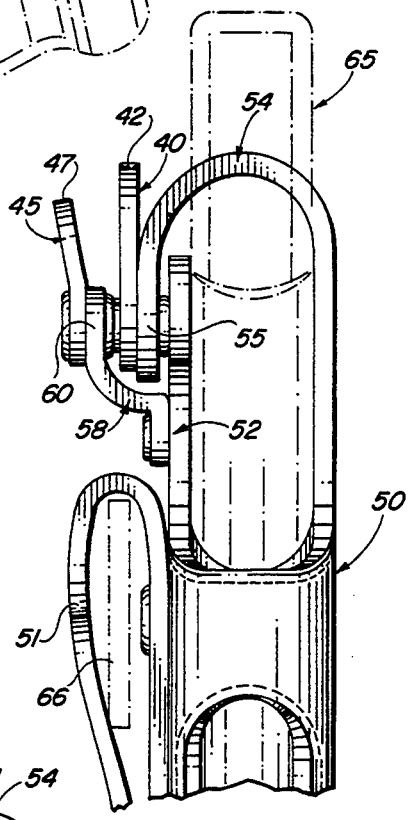
FIG. 2 is a side view of the safety snap assembly engaged in fastening position on a weapon holster.

Shown throughout FIGS. 1–5, the present invention is directed towards a safety snap assembly generally indicated as 10. The assembly 10 can be utilized to provide a secure closure for any of a variety of containers such as handbags, briefcases and the like, but preferably is to be utilized as part of a weapon holster such as the gun holster 50 illustrated throughout the drawings. The gun holder 50 is of the type which has a primary weapon holding housing sized to receive a particular gun 65 therein. This type of holster 50, which is commonly employed by police officers, is secured about an officer's waist utilizing a belt 66 which passes through a retaining loop 51 secured to the holster 50. In such a manner, the holster 50 is maintained at the side of a using police officer. Also included as part of the holster 50 is a first protruding containment segment 52 which is integrally formed with the housing and extends upwardly from an inner side of the housing which is adjacent the wearer when the holster is properly positioned. It should be noted that depending upon whether the user is right-handed or left-handed, and accordingly requires the holster 50 to be disposed on their right or left-hand side, the first protruding containment segment 52 will preferably be a side adjacent to the user.

Figure 4:
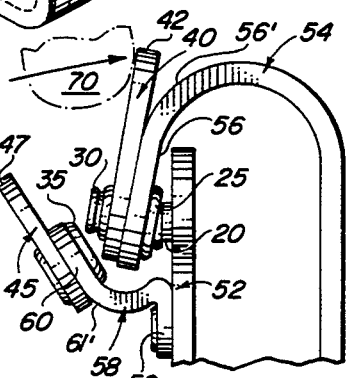
FIG. 4 is a side view of the safety snap assembly illustrating a final step required to release the assembly.
Figure 5:
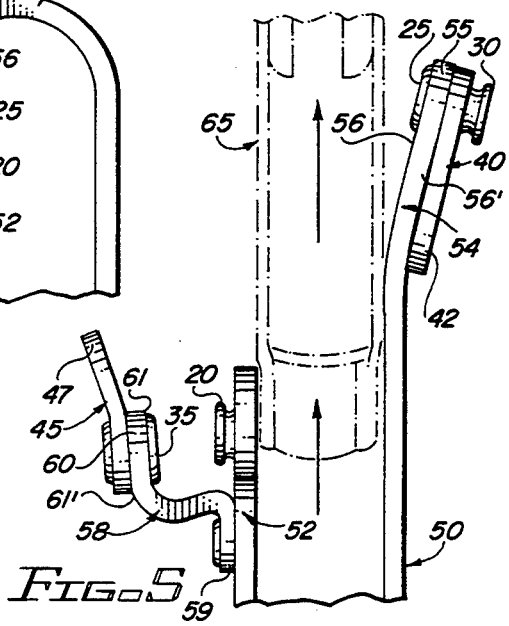
FIG. 5 is a side view of the safety snap assembly in a fully released and opened orientation to enable removal of a weapon from the holster.

Extending from an outer side of the housing of the holster 50 is a second strap segment 54. This second segment 54 is adapted to be disposed about a rear of the weapon 65 contained within the housing of the holster 50, the second segment 54 being secured at the first segment 52 thereby maintaining and containing the weapon 65 within the holster 50. In order to ensure that the second segment 54 is securely maintained about the weapon 65 such that unwanted users cannot easily remove the gun 65 from the holster 50, the safety snap assembly 10 is utilized. Included as part of the safety snap assembly 10 is a first snap member 20, as best seen in FIG. 5. Preferably, this first snap member 20 will be a male snap. Disposed on an interior surface 56 of a free distal end 55 of the second segment 54 is a second snap member 25. This second snap member 25 is preferably a female snap and is adapted to be matingly engaged with the first snap member 20 on the first segment 52, thereby enabling the second segment 54 to be removably secured about the weapon 65 and fastened to the first segment 52. Secured to an exterior surface 56' of the free distal end 55 of the second strap segment 54 is a first release means 40. This first release means 40, which is adapted to facilitate disengagement of snap member 25 on the second segment 54 from the snap member 20 on the first segment 52 is substantially rigid and is preferably formed of thick leather or plastic. Included as part of these release means 40 is a protruding, exposed actuator end 42 or "thumb break." This protruding, exposed actuator end 42 is adapted to be pushed towards the first segment 52 and the second segment 54, as illustrated in FIG. 4, so as to disengage the second snap member 25 from the first snap member 20. Preferably, the snap members 20 and 25 are unidirectional snaps such that disengagement will occur only if the actuator end 42 is pushed towards the segments 52 and 54 and not if the actuator end is pushed away from the segments 52 and 54 and towards the user's body.

Also positioned on an exterior 56' of the free distal end 55 of the second segment 54 is a third snap member 30. This third snap member 30 is positioned opposite the second snap member 25 on the free distal end 55 of the second segment 54, and is preferably a male snap. Extending from the first segment 52 is a third segment 58. This third segment 58 includes a proximal end 59 and a distal end 60, and is fixedly secured to the first segment 52 at its proximal end 59. The proximal end 59 of the third segment 58 is secured to the first segment 52 preferably by a rivet or other appropriate fastening means. Further, the third segment 58 is formed of a strong flexible material such as a leather strip. Disposed on an interior surface 61 of the distal end 60 of the third segment 58 is a fourth snap member 35. This fourth snap member 35 is preferably a female snap so as to be matingly and releasably engaged with the third snap member 30 on the free distal end 55 of the second segment 54. In order to facilitate disengagement of the fourth snap member 35 from the third snap member 30, a second release means 45 are included. These second release means 45 are secured to an exterior surface 61' of the third segment 58 at the distal end 60 of the third segment 58. These second release means will include a concealed actuator end or "thumb break" 47, which is also preferably substantially rigid. This concealed actuator end 47 of the second release means 45 is structured and disposed to be pushed away from the second and third segments 54 and 58, and towards the body of a user in order to disengage the fourth snap member 35 from the third snap member 30. The third snap member 30 and fourth snap member 35 are also preferably unidirectional snaps such that only when the actuator end 47 is pushed towards the user's body will the snaps become disengaged.

Turning to FIG. 1, the first release means 40 are sized such that they will substantially conceal the second release means 45 there-behind. Specifically, an unwanted user attempting to release the weapon 65 from the holster 50, when viewing the safety snap assembly 10 from an exterior of the user will only view the first release means 40, and specifically the exposed actuator end 42 on the first release means 40. As a result, if they attempt to steal the weapon 65 by quickly releasing the snaps, the exterior appearance of the safety snap assembly 10 will lead the unwanted user to pushing the exposed actuator end 42 of the first release means 40 away from the holster 50 and towards the user's body, a procedure which will not serve to disengage the safety snap assembly 10 and release the weapon 65. Further, even if the actuator end 42 of the first release means 40 is pushed towards the holster 50, disengagement will not occur unless the concealed actuator end 47 of the second release means 45 is first pushed away from the holster 50 and towards the user's body.

Figure 3:
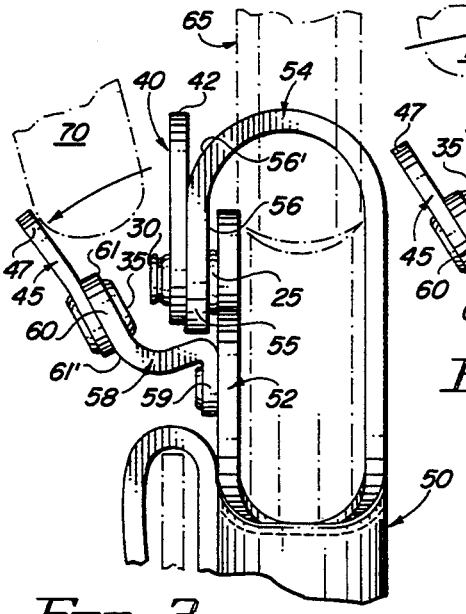
FIG. 3 is a side view of the safety snap assembly illustrating an initial release step required to release the assembly.

In use, a police officer, or other holster user will be able to quickly release a weapon such as the gun 65 from the holster 50 utilizing the rapid two-step process illustrated in FIGS. 3–4. Turning to FIG. 3, the first step involves engaging the weapon handle 65 and, preferably with the thumb 70, pushing the concealed actuator end 47 of the second release means 45 away from the holster 50 in the direction as show by the arrow to thereby disengage the third snap member 30 from the fourth snap member 35. Next, as illustrated in FIG. 4, the thumb 70 is moved towards the holster 50 (again in the direction shown by the arrow) to push the exposed actuator end 42 on the first release means 40. In this manner, the second snap member 25 is disengaged from the first snap member 20 such that the weapon 65 can be quickly pulled from the holster 50 as shown in FIG. 5. Removal of the weapon from the holster can be accomplished simultaneously as part of the second step. For example, if the wearer's hand is already wrapped about the handle of the gun when the release means 40 is pushed with the thumb 70 the gun 65 can be lifted out of the holster at the same moment and thus be immediately ready for use.

In addition to concealing the second release means 45 behind the first release means 40 so as to provide the illusion that the first release means 40 are the sole release means present, the requirement that an unwanted user must first find the second release means 45, will make it substantially difficult for the unwanted user to access the weapon either quickly or without being noticed. Moreover, even if such a person knows that the second release means 45 must be release first, the wearer will be alerted to him because it must be released towards the wearer's body in the direction of the arrow shown in FIG. 3. Thus, the person wearing the holster of this invention will likely have sufficient time to prevent removal of the weapon 65.

The present invention as described herein illustrates the preferred embodiment of this invention. The safety snap assembly 10, however, can be utilized in a variety of weapon holsters such as knife sheaves, or for use in a variety of gun holsters, along with its many non-weapon oriented uses, and should not be limited except as called for by the claims and as necessitated by the doctrine of equivalents.

Now that the invention has been described,

What is claimed is:

1. In combination with a weapon holster of the type including a primary weapon holding housing with a first protruding containment segment extending upwardly from an inner side of the housing, and a second strap segment extending from an outer side of the housing and structured to be disposed about a rear of a weapon contained within the weapon holding housing and secured at the first protruding containment segment so as to contain the weapon within the housing; a safety snap assembly comprising:

a first snap member disposed on the first segment, a second snap member structured and disposed to be matingly engaged with said first snap member, said second snap member being disposed on an interior surface of a free distal end of the second segment such that said free distal end of the second segment is removably secured to the first segment upon snapped engagement of said first snap member with said second snap member, a first release means secured to an exterior of said free distal end of the second segment, said first release means being structured and disposed to facilitate disengagement of said second snap member from said first snap member, said first release means including a protruding, exposed actuator end structured and disposed to be pushed toward the first and the second segments so as to disengage said second snap member from said first snap member, a third snap member disposed on the exterior of said free distal end of the second segment, opposite said second snap member, a third segment including a proximal end and a distal end, said third segment being fixedly secured at said proximal end thereof to the first segment, a fourth snap member disposed on an interior of said distal end of said third segment and structured and disposed to be matingly and releasably engaged with said third snap member on said exterior of said free distal end of the second segment, a second release means secured to an exterior of said distal end of said third segment, said second release means being structured and disposed to facilitate disengagement of said fourth snap member from said third snap member, said second release means including a concealed actuator end structured and disposed to be pushed away from the second and said third segments so as to disengage said fourth snap member from said third snap member, and said first release means being sized to conceal said second release means there behind, disengagement of said fourth snap member from said third snap member by said second release means being required prior to said first release means disengaging said second snap member from said first snap member.

2. An assembly as recited in claim 1 wherein said first release means are substantially rigid.

3. An assembly as recited in claim 2 wherein said second release means is substantially rigid.

4. An assembly as recited in claim 1 wherein said first snap member and said second snap member are uni-directional snaps such that they will disengage from one another only when said exposed actuator end of said first release means is pushed toward the first and the second segments.

5. An assembly as recited in claim 4 wherein said third snap member and said fourth snap member are uni-directional snaps such that they will disengage from one another only if said second release means is pushed away from the second and said third segments.

6. A safety snap assembly comprising:

a first snap member disposed on a first segment, a second snap member structured and disposed to be matingly engaged with said first snap member, said second snap member being disposed on an interior surface of a free distal end of a second segment such that said free distal end of said second segment is removably secured to said first segment upon snapped engagement of said first snap member with said second snap member, a first release means secured to an exterior of said free distal end of said second segment, said first release means being structured and disposed to facilitate disengagement of said second snap member from said first snap member, said first release means including a protruding, exposed actuator end structured and disposed to be pushed toward said first and said second segments so as to disengage said second snap member from said first snap member, a third snap member disposed on said exterior of said free distal end of said second segment, opposite said second snap member, a third segment including a proximal end and a distal end, said third segment being fixedly secured at said proximal end to said first segment, a fourth snap member disposed on an interior of said distal end of said third segment and structured and disposed to be matingly and releasably engaged with said third snap member on said exterior of said free distal end of said second segment, a second release means secured to an exterior of said distal end of said third segment, said second release means being structured and disposed to facilitate disengagement of said fourth snap member from said third snap member, said second release means including a concealed actuator end structured and disposed to be pushed away from said second and said third segments so as to disengage said fourth snap member from said third snap member, and said first release means being sized to conceal said second release means there behind, disengagement of said fourth snap member from said third snap member by said second release means being required prior to said first release means disengaging said second snap member from said first snap member.

7. An assembly as recited in claim 6 wherein said first release means are substantially rigid.

8. An assembly as recited in claim 7 wherein said first snap member and said second snap member are uni-directional snaps such that they will disengage from one another only when said exposed actuator end of said first release means is pushed toward said first and said second segments.

9. An assembly as recited in claim 8 wherein said second release means is substantially rigid.

10. An assembly as recited in claim 9 wherein said third snap member and said fourth snap member are uni-directional snaps such that they will disengage from one another only if said second release means is pushed away from said second and said third segments.

* * * * *